US006982416B2

(12) United States Patent
Villinger et al.

(10) Patent No.: US 6,982,416 B2
(45) Date of Patent: Jan. 3, 2006

(54) METHOD AND DEVICE FOR EVALUATING THE STATE OF ORGANISMS AND NATURAL PRODUCTS AND FOR ANALYZING A GASEOUS MIXTURE COMPRISING MAIN CONSTITUENTS AND SECONDARY CONSTITUENTS

(75) Inventors: Johannes Villinger, Österreich (AT); Werner Federer, Österreich (AT)

(73) Assignee: V & F Analyse - und Messtechnik Ges. m.b.H. (AT)

( * ) Notice: Subject to any disclaimer, the term of this patent is extended or adjusted under 35 U.S.C. 154(b) by 0 days.

(21) Appl. No.: 10/433,370

(22) PCT Filed: Dec. 14, 2001

(86) PCT No.: PCT/EP01/14804

§ 371 (c)(1),
(2), (4) Date: Sep. 22, 2003

(87) PCT Pub. No.: WO02/058106

PCT Pub. Date: Jul. 25, 2002

(65) Prior Publication Data

US 2004/0046567 A1 Mar. 11, 2004

(30) Foreign Application Priority Data

Dec. 15, 2000 (EP) ..... 00127558

(51) Int. Cl.
*B01D 59/44* (2006.01)
*H01J 49/00* (2006.01)

(52) U.S. Cl. ..... 250/288; 250/281; 250/282

(58) Field of Classification Search ..... 250/281, 250/282, 288

See application file for complete search history.

(56) References Cited

U.S. PATENT DOCUMENTS 4,018,241 A 4/1977 Sodal et al.
4,975,576 A * 12/1990 Federer et al. ..... 250/282
5,032,722 A 7/1991 Boesl et al.
5,750,988 A * 5/1998 Apffel et al. ..... 250/288
6,207,954 B1 * 3/2001 Andrien et al. ..... 250/288
6,583,409 B2 * 6/2003 Kato ..... 250/288
6,657,191 B2 * 12/2003 Park ..... 250/288

FOREIGN PATENT DOCUMENTS

| | | |
|---|---|---|
| DE | 196 28 093 | 1/1998 |
| EP | 0 290 711 | 7/1987 |
| EP | 0 290 712 | 7/1987 |
| WO | WO 99/20177 | 4/1999 |
| WO | WO 00 74553 | 12/2000 |

* cited by examiner

*Primary Examiner*—John R. Lee
*Assistant Examiner*—Paul M. Gurzo
(74) *Attorney, Agent, or Firm*—Fay, Sharpe, Fagan, Minnich & McKee, LLP

(57) ABSTRACT

The invention relates to a method for assessing the state of organisms and natural products wherein one or more substances are determined in a gaseous mixture, determination being effected by a mass spectrometer wherein an ion beam acts on the sample of gaseous mixture in high vacuum in such a way that the test molecules are ionized with the aid of the internal energy of the ions of the ion beam, and the values obtained upon determination are evaluated for assessing the state.

Further, the invention relates to a method for analyzing a gaseous mixture with one or more main components and one or more secondary components wherein at least one main component is determined in the concentration range greater than or equal to 0.1 percent by volume and one secondary component in the concentration range of less than or equal to 0.1 percent by volume by a mass spectrometer wherein an ion beam acts on the sample of gaseous mixture in high vacuum in such a way that the test molecules are ionized with the aid of the internal energy of the ions of the ion beam, and to an apparatus for analyzing a gaseous mixture comprising a mass spectrometer with a gas delivery system wherein a molecular beam is produced in an intermediate vacuum from the sample of gaseous mixture under analysis, a second molecular beam then being produced from said beam in high vacuum by means of a pressure gradient in a capillary and the test molecules of the second molecular beam ionized, the pressure of the intermediate vacuum being kept constant.

17 Claims, 2 Drawing Sheets

METHOD AND DEVICE FOR EVALUATING THE STATE OF ORGANISMS AND NATURAL PRODUCTS AND FOR ANALYZING A GASEOUS MIXTURE COMPRISING MAIN CONSTITUENTS AND SECONDARY CONSTITUENTS

The present invention relates to a method for assessing the state of organisms and natural products emitting substances into the surrounding atmosphere wherein one or more of said substances are determined in a gaseous mixture, to a method for analyzing a gaseous mixture with main and secondary components, and to an apparatus for carrying out said methods that comprises a mass spectrometer with a gas delivery system.

Invasive methods are primarily used for assessing the state of organisms and natural products, i.e. samples are taken from the subject under examination and then analyzed in laboratories. For example, clinical pictures and metabolic disturbances are identified in modern medical diagnostics on the human body mainly by examinations of blood, urine or stool. These methods have firstly the disadvantage that sampling directly affects the subject under examination. Secondly, they sometimes require elaborate sampling such as collections of blood on persons by medical specialists. In addition, the analysis of the sample itself can only be done by trained personnel and the analyses mostly require a great expenditure of time.

Further, methods such as $^{13}C$ analytics of human expiratory air are known for determining gastritic *Helicobacter pylori* infection using mass spectrometers. Such methods have the disadvantage of being geared very specifically to determining a certain component and only being able to determine this component within a narrow concentration range. Moreover, a provocative agent must be taken by the test subject prior to analysis of the gaseous mixture, or the sample pretreated, e.g. concentrated, after sampling.

In the field of gaseous mixture analysis, various methods are known that use mass spectrometers, for example the coupling of gas chromatograph and mass spectrometer (GC/MS). Such methods have the disadvantage of being very time-consuming and thus cost-intensive for the determination of several components of a gaseous mixture in different concentration ranges.

It is therefore a problem of the present invention to provide a method for assessing the state of organisms and natural products emitting substances into the surrounding atmosphere that avoids the disadvantages of known prior art methods.

In addition, it is a problem of the present invention to provide a method for analyzing gaseous mixtures that allows fast determination of main and secondary components of the gaseous mixture.

A further problem of the invention is to provide an apparatus for analyzing gaseous mixtures that is suitable for carrying out the aforementioned methods and allows fast analysis of samples of gaseous mixtures whose components are present in a wide concentration range.

The invention is based on the finding that the abovementioned problems can be solved with the aid of a mass spectrometer wherein an ion beam acts on the sample of gaseous mixture under analysis in high vacuum in such a way that the test molecules are ionized with the aid of the internal energy of the ions of the ion beam.

The present invention therefore provides a first method for assessing the state of organisms and natural products emitting substances into the surrounding atmosphere wherein one or more of said substances are determined as components of a gaseous mixture, determination being done by a mass spectrometer wherein an ion beam acts on the sample of gaseous mixture in high vacuum in such a way that the test molecules are ionized with the aid of the internal energy of the ions of the ion beam, and the values obtained upon determination are evaluated for determining the state.

The inventive method can be used for assessing the state of living and dead organisms and parts thereof, as well as natural products of all kinds. Natural products refer according to the invention to natural products such as fruit, vegetables, meat, cow's milk, etc., products obtained by natural production methods such as wine, beer, cheese, edible oil, etc., and products obtained by processing natural products such as coffee beans, smoked ham, etc.

Gaseous mixtures refer according to the invention to mixtures of substances containing not only main components that are gaseous at room temperature but also further components located in the gas phase formed by the main components.

Mass spectrometers wherein an ion beam acts on a gaseous mixture in high vacuum in such a way that the test molecules are ionized with the aid of the internal energy of the ions of the ion beam are known for example from EP 0 290 711, EP 0 290 712 and DE 196 28 093. The disclosure of these prints is incorporated herein by reference.

The inventive method has the advantage that no samples need be taken artificially from the organism or natural product under examination, thereby avoiding all injury to the organism or natural product. This is thus a noninvasive method. A further advantage of the method is that the method for analyzing a sample takes only a short time in the range of a few minutes. In addition, the method offers the advantage that when several components of the gaseous mixture under analysis are determined, substantially no interferences are obtained upon determination of the components that prevent analysis of individual determined components.

In a preferred embodiment, the method is used for assessing the state of humans and animals. The advantage that no samples, such as blood samples, need be taken from the subject under examination is particularly brought to bear here, because such sampling must be done by trained personnel, for example physicians in the case of humans. In addition, such sampling is felt to be unpleasant by humans and animals. In contrast, the inventive method, being a noninvasive method, offers the advantage that sampling is firstly not felt to be unpleasant and secondly can also be done by untrained personnel or by the test subject himself.

In a further preferred embodiment, human expiratory air is used as the gaseous mixture in the inventive method. This offers the advantage that sampling can firstly be done very simply and secondly the substances obtained in expiratory air permit assessment of the test subject's state in regard to a great number of clinical pictures and metabolic processes.

Further preferably, the gaseous mixture under analysis comprises main components and secondary components, the concentration of the main components being below that of the secondary components by at least a factor of 10, preferably 50, further preferably 100.

In a further preferred embodiment of the present invention, the gaseous mixture under analysis comprises main and secondary components, at least one of the main components being determined in the concentration range of greater than or equal to 0.1 percent by volume, preferably greater than or equal to 1 percent by volume, and at least one secondary component in the concentration range of less than or equal to 0.1 percent by volume, preferably less than or equal to 0.03 percent by volume.

Further preferably, a correlation is established between at least one main component and at least one secondary component for evaluating the data obtained by the mass spectrometer. This can be done for example by calibrating the determination of one or more secondary components to the determination of one or more main components.

In a further preferred embodiment of the present invention, the sample of gaseous mixture is supplied to the mass spectrometer without pretreatment. This offers the advantages of firstly minimizing the time required for measuring a sample and secondly omitting further costs due to pretreatment steps, such as concentration of the sample.

Further preferably, two or more substances of the gaseous mixture with different molecular structure are determined with one measurement in the inventive method.

In a further preferred embodiment, the concentration of one or more of the substances contained in the gaseous mixture is determined quantitatively in the inventive method. Since the inventive method comprises determination by a mass spectrometer wherein an ion beam acts on the sample of gaseous mixture in high vacuum in such a way that the test molecules are ionized with the aid of the internal energy of the ions of the ion beam, the quantities of the determined substances are linearly proportional to the detected signal, so that quantitative detection can be done in a simple way. Quantitative determination in addition offers the advantage of permitting further-reaching statements to be made about the state of the organism or natural product. In particular, when multiple measurements are taken consecutively one can ascertain changes of the concentrations of substances and thus changes of the state of the organism or natural product.

Further preferably, the concentration of at least one of the main components and at least one, preferably more, of the secondary components is determined quantitatively. Preferably, the concentration of the determined secondary component(s) is calibrated with the aid of the concentration of one or more of the determined main components upon evaluation of the mass spectrometer data in this preferred embodiment.

In a further preferred embodiment of the inventive method, the inventive method is used to determine only substances having a vapor pressure of at least $10^{-3}$ millibars at room temperature. Further preferably, all components of the gaseous mixture with a vapor pressure greater than or equal to $10^{-3}$ millibars are determined.

In a further preferred embodiment of the present invention, the main components of the gaseous mixture under analysis are substantially identical to those of atmospheric air. Further preferably, the concentrations of the main components of the gaseous mixture under analysis are also substantially identical to those of atmospheric air or that of human expiratory air.

In a further preferred embodiment of the present invention, all components of the gaseous mixture under analysis that have a molecular mass of up to 500, preferably a molecular mass of up to 200, are detected quantitatively upon detection in the mass spectrometer.

In a further preferred embodiment of the present invention, the ion beam acting on the test molecules in high vacuum comprises an atomic ion beam.

Further preferably, the ion beam comprises ions that are in the ground electronic state and/or in a selectively excited metastable state.

In a further preferred embodiment of the present invention, the ion beam acting on the test molecules in high vacuum comprises at least two ion beams with different ionization potential.

In a further preferred embodiment of the present invention, the ion beam acting on the test molecules in high vacuum comprises a mercury ion beam.

In a further preferred embodiment of the present invention, the ion beam acting on the test molecules in high vacuum comprises a mercury ion beam and additionally a krypton ion beam and/or a xenon ion beam.

Further preferably, the different ion beams act on the test molecules in high vacuum successively.

Preferably, the present method is used to determine substances with an ionization potential less than 17 electron volts.

The present invention in addition provides a second method for analyzing a gaseous mixture with one or more main components and one and more secondary components, at least one main component being determined in the concentration range greater than or equal to 0.1 percent by volume, preferably greater than or equal to 1 percent by volume, and at least one secondary component in the concentration range less than or equal to 0.1 percent by volume, preferably less than or equal to 0.03 percent by volume, by a mass spectrometer wherein an ion beam acts on the sample of gaseous mixture in high vacuum in such a way that the test molecules are ionized with the aid of the internal energy of the ions of the ion beam.

This method offers the advantage of allowing fast and simultaneous determination of main and secondary components of a gas mixture and therefore permitting extensive statements to be made about the gas mixture.

In a preferred embodiment, a correlation is established between at least one main component and at least one secondary component for evaluating the data obtained by the mass spectrometer. This offers for example the advantage that evaluation of the data can be done by standardizing the data of the secondary components to those of the main components. In addition, the share of main components for example permits faulty samples to be inferred and eliminated.

Further preferred embodiments of this method are also those described for the first inventive method which are applicable to the second one.

The present invention in addition provides an apparatus for analyzing gaseous mixtures that comprises a mass spectrometer with a gas delivery system wherein a molecular beam is produced in an intermediate vacuum from the sample of gaseous mixture under analysis, a second molecular beam then being produced from said beam in high vacuum by means of a pressure gradient in a capillary, and the test molecules of the second molecular beam ionized, the pressure of the intermediate vacuum being kept constant.

The inventive apparatus offers the advantage that the second molecular beam passing into the high-vacuum analyzer of the mass spectrometer has a constant particle density. In this way the viscosity of the second test molecular beam is kept constant. In addition, the apparatus obtains a high density of the second test molecular beam, whereby single-impact conditions simultaneously prevail for the action of the ion beam on the test molecular beam. Thus, the sensitivity of the mass spectrometer can firstly be increased up to the parts-per-billion range, and simultaneously components of gaseous mixtures determined in the volume percentage range.

In addition, the gas delivery system of the inventive apparatus is inert to the components contained in the sample of gaseous mixture, so that it is unnecessary to rinse the system before measuring a new sample.

Preferably, the test molecules of the second molecular beam are ionized with the aid of the internal energy of the ions of an ion beam.

In a preferred embodiment of the inventive apparatus, the ion beam acting on the test molecules in high vacuum comprises at least two ion beams with different ionization potential.

In a further preferred embodiment of the inventive apparatus, the ion beam acting on the test molecules in high vacuum comprises an atomic ion beam.

Further preferably, the ion beam comprises ions that are in the ground electronic state and/or in a selectively excited metastable state.

In a further preferred embodiment of the inventive apparatus, the ion beam acting on the test molecules in high vacuum comprises a mercury ion beam.

In a further preferred embodiment of the inventive apparatus, the ion beam acting on the test molecules in high vacuum comprises a mercury ion beam and additionally a krypton ion beam and/or a xenon ion beam.

Further preferably, the different ion beams act on the test molecules in high vacuum successively.

In a further preferred embodiment of the apparatus, the ionized molecular beam is stored with the aid of an octupole guide field.

Further preferably, the pressure of the intermediate vacuum is 0.2 to 200 millibars, preferably 1 to 100 millibars and further preferably 5 to 50 millibars.

Preferably, the pressure of the high vacuum is no more than 10-7 millibars.

The molecular beam in the intermediate vacuum is preferably produced by means of a pressure gradient between the gaseous mixture supplied to the mass spectrometer, the pressure of said mixture preferably being greater than or equal to 500 millibars, and the intermediate vacuum.

The inventive methods preferably comprise the use of the inventive apparatus.

In the following, some areas of application of the present invention will be stated.

Human expiratory air contains not only the main components, nitrogen, oxygen, water and $CO_2$, but also more than 400 volatile substances. Nitrogen and oxygen together constitute more than 90 percent of expiratory air, $CO_2$ is about 5 percent and water may be present in concentrations of up to 40 milligrams per liter at 37° C. In contrast, most of the other volatile substances in respiratory air are present only as secondary components in concentrations distinctly below those of the main components. However, specifically the secondary components of respiratory air permit extensive conclusions to be drawn about the state of human health or metabolic processes taking place in humans.

For example, an elevated content of methane in respiratory air can be caused by abnormal colonization of the small bowel with large-bowel bacteria, which produce methane in the small bowel that passes via the bloodstream into the lung and thus into expiratory air. Further, elevated methane values can also occur with certain types of malnutrition.

In diabetics, expiratory air has an elevated content of acetone.

Cancer cells in the body may cause an increase in the aldehyde content in expiratory air.

In hepatitis patients, propanol content in relation to ethanol content in expiratory air is elevated by about a factor of 10.

The pentane level in expiratory air is a measure of changes of lipase activity in the body and resulting illnesses. For example, an elevated pentane level is detected with rheumatic inflammations, with lung injuries from inhalation of high oxygen concentrations, in cardiac infarction patients and in patients with cancer of the respiratory organs. Pentane content in expiratory air may also be increased with schizophrenia and multiple sclerosis. In addition, a linear relation has been ascertained between the age of test subjects and pentane content in their expiratory air.

In schizophrenia patients, an elevated content of $CS_2$ and $H_2S$ in expiratory air is also ascertained.

Bacterial loads causing foci of inflammation produce an elevated content of NO in expiratory air.

Changes of the NO and $NO_2$ content of expiratory air are ascertained with gastro-intestinal illnesses.

In asthmatics, the content of NO in expiratory air is likewise elevated.

With hemolytic illnesses for example in newborns, the CO content in expiratory air is elevated.

In lung cancer patients, the content of certain volatile organic compounds is elevated.

In smokers, the content of 2,5-dimethylfuran in expiratory air is elevated.

In addition, a strong change of respiratory air components is to be ascertained with fetor ex ore (bad breath caused locally in the mouth and nasopharyngeal space) and with halitosis (bad breath). With these illnesses, comparative measurement of human expiratory air, exhaled first through the mouth and then through the nose, makes it possible to ascertain whether there is a local cause in the oral, pharyngeal or nasal space or whether another illness is present.

An elevated content of ketones in expiratory air is detected if the fatty acid supply in the body is high due to increased lipolysis. This can be attributed to different causes such as hunger or insulin deficiency (diabetes mellitus).

With ketonuria, an elevated concentration of ketone bodies (acetacetate, R3 hydroxybutyrate and acetone) is likewise ascertained. This is to be attributed to the glycogen deficiency in the liver as a result of failed carbohydrate metabolism. With keto-acidosis, as exists for example with diabetic coma, fasting states or alcoholism, an elevated content of propionic acid and butyric acid in expiratory air can be ascertained.

With chronic renal insufficiency and uremia, an elevated content of for example phenols in expiratory air can be determined.

The metabolites of bacteria located in the human body such as $CO_2$ and $H_2$ (*Escherichia coli*) or $H_2S$ (Proteus) can also be found in expiratory air. Specifically with infection by clostridia (gas gangrene bacteria), volatile fatty acids can be detected.

After intake of lipoprotein-containing food, an acetone and $NH_3$ content is ascertained that is lower than before food intake, said content rising again only slowly. Directly after food intake, an elevated content of ethanol can be ascertained. The content of isoprene and methanol remains substantially unchanged.

In case of intolerance to certain sugars, an elevated content of $H_2$ in expiratory air can be ascertained in test subjects after their intake.

In case of tiredness, an elevated content of isoprene is ascertained.

When mood-improving pharmaceuticals are used, an elevated number of amine compounds may be present in respiratory air. Accordingly, the inventive method can be used for example to check pilots, train conductors or, bus drivers before they begin running the particular means of locomotion.

When doping agents are taken for example by top athletes before matches, the composition of expiratory air is likewise changed vis-à-vis undoped athletes. Thus, athletes can also be checked for intake of dope before matches.

The inventive method can thus be used for diagnosing all kinds of clinical pictures and metabolic disturbances in the human body.

In addition, the inventive method can be used for monitoring the metabolism of organisms upon intake of pharmaceuticals, monitoring therapeutic measures, e.g. continuously checking healing processes, and also monitoring provocation tests in which a substance is administered in a certain (high) dose and the body's reaction to the substance traced.

The inventive method is not limited to analysis of human expiratory air. Samples can also be taken for example of human gaseous mixtures of a different nature, such as perspiration, and the gas phases of urine, blood, feces and other body fluids.

Sampling can be done for analysis of perspiration for example by the test subject taking up some perspiration by a wad, the gas phase above the wad being analyzed.

In addition, the inventive method can be used for quality control of natural products of all kinds, where for example the occurrence of certain gaseous substances in the gas phase above the natural product can indicate decomposition of the product. For example, in analysis of the gas phase above fresh meat, lactic acid is first ascertained, then increasingly $NH_3$ with increasing age and finally S compounds.

A further conceivable application of the inventive method is the detection of animals suffering from BSE for example via the changed composition of their expiratory air.

Further areas of application of the inventive method result from the article by B. Krotoszynski et al., J. Chromatograph. Sci. 15 (1977) 239–244, which describes possibilities of diagnosis by the analysis of human expiratory air. The disclosure of this article is incorporated herein by reference.

As the above examples of application indicate, the state of organisms or natural products will usually be assessed with respect to a certain question, such as the presence of a certain illness. Therefore, it is preferable for the inventive method that the key components relevant to the particular question are determined in the gaseous mixture.

Preferably, at least two, further preferably at least three, and especially preferably at least five, of the key components are therefore determined in the inventive method. Further preferably, at most twenty, especially preferably at most ten, of the key components are determined.

In the following, the inventive methods and apparatus will be described with reference to further preferred details. The present detailed description relates mainly to the analysis of human expiratory air.

Figure 1:
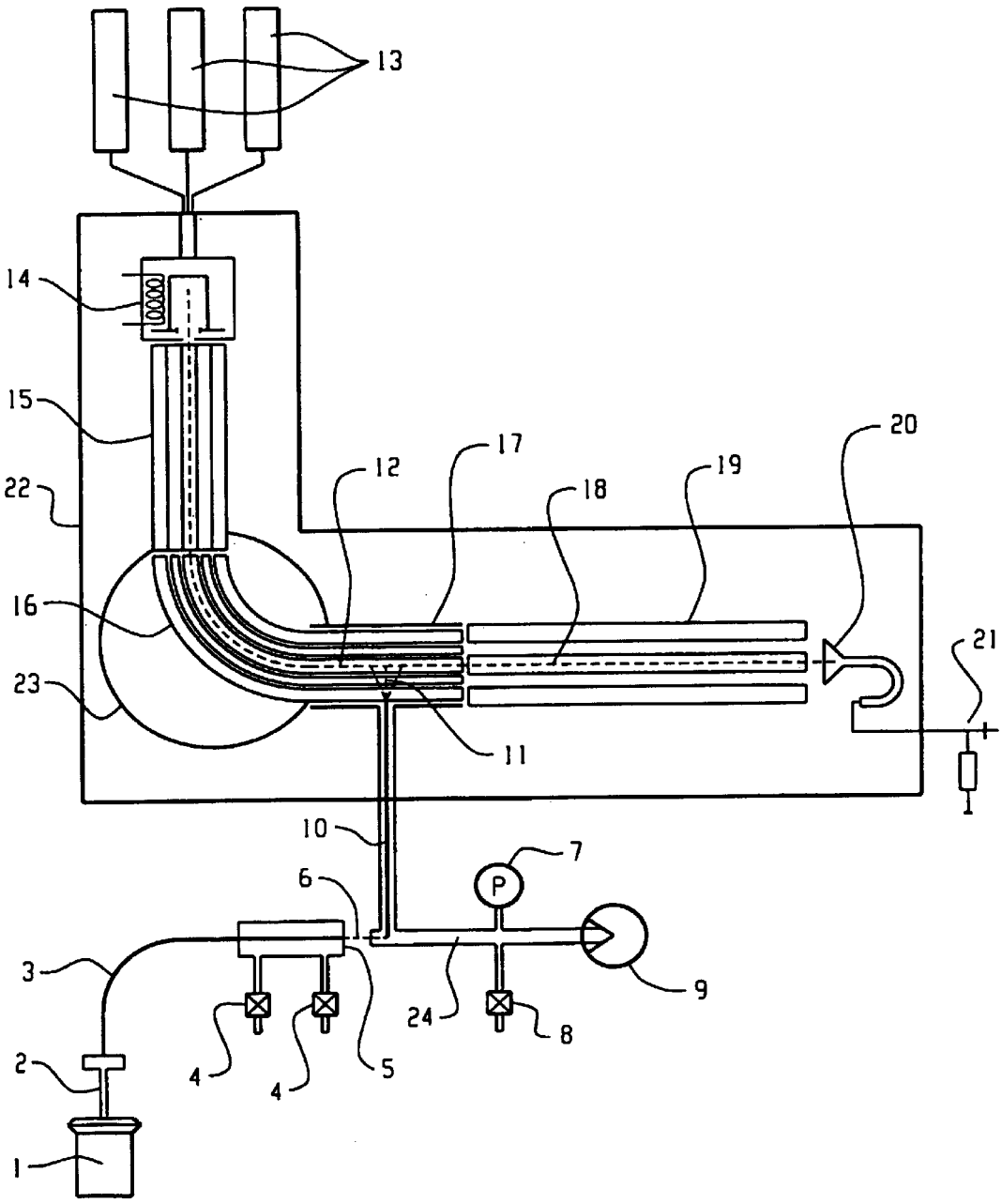
FIG. 1 shows the inventive apparatus in a schematic drawing.

Sampling and the supply of samples to the mass spectrometer can be effected firstly in such a way that a direct connection is produced between the gas space where the gas mixture under analysis is located, and the mass spectrometer. In the case of analysis of human expiratory air, this can be done with the aid of a breathing mask, as described for example in WO 99/20177.

Respiratory air exhaled by a test subject is supplied through this breathing mask directly to the mass spectrometer. This permits online real-time data of the test subject's respiratory air components to be obtained since the response time of the mass spectrometer to changes of the supplied gaseous mixture is in the range of milliseconds. For example, quickly progressing metabolic changes in the test subject, such as fast degradation of an easily degradable pharmaceutical, can be observed directly.

This method (online method) can be used for example in emergency medicine, for example for detecting rapidly worsening states of health. A further application of the online method may be real-time monitoring of metabolic processes for example after a provocative test.

Sampling can also be done in such a way that test subject and mass spectrometer are separated from each other in time and/or in space, so that the expiratory air sample must first be stored in a suitable vessel. Glass vials with a preferred volume of 20 milliliters are preferably used here.

Such vials have the first advantage of being very cost-effective, which makes them suitable for one-time use. In addition, they have excellent inertness compared to other gas storage systems, and they are very easily handled by an autosampler.

Sampling is done by the test subject evenly inhaling (preferably through the nose) and exhaling through an ordinary drinking straw into the vial about 1 to 2 centimeters above the vessel bottom. The vial is then sealed in airtight fashion. This is preferably done with a crimp cap, which is firmly crimped to the glass vial after sampling. It has been ascertained that a time of a few seconds when the vial is still unsealed after expiration by the test subject has no negative effects, such as a change of composition, on the gaseous mixture exhaled by the test subject.

The crimp cap is preferably formed so as to be completely covered with Teflon in the area where there is direct contact of the cap with the interior of the vessel, that is, with the exhaled gaseous mixture. The opening of the glass vial is advantageously designed so that its top rim has a conically outward sloping form. The crimp cap can thus be formed so as to embrace an outer ring of butyl rubber that clings elastically to the conical outside wall of the vial and thus has a sealing effect. This preferred embodiment of the glass vial seal guarantees maximum inertness to the gaseous mixture exhaled by the test subject.

To permit ascertainment of the composition of the ambient air where the test subject is located and any contaminations in this ambient air, a second vial that has not come in contact with the test subject's respiratory air is sealed in the test subject's surroundings (reference vial) parallel to the glass vial filled with the test subject's exhaled breath.

The test subject's expiratory air can be stored in the sealed glass vials for several days without a loss of quality. This is useful for example for transporting samples from the attending physician to the analyzing lab. This manner of sampling is also referred to as the offline method. It has the advantage that it can also be done by untrained personnel due to its simplicity.

In determining the state of natural products, sampling can likewise be done offline or online. For example, in offline sampling, one can seal a glass vial that has been in contact with the gas phase immediately above the product under examination for some time.

For supplying samples to the mass spectrometer, the samples are first mounted on an autosampler for example. This may be for example a modified CNC system of the "Step-Four Basic 540 Milling" type that has been modified so as to fully automatically sample 70 samples consisting of 70 sample vials and reference vials.

Before being supplied to the mass spectrometer, the sample is preferably heated to a higher temperature than room temperature, further preferably 65° C. This offers the advantage of increasing the reproducibility in the analytics of the samples, on the one hand, and permitting water-soluble polar compounds, that is, ones dissolved in the moisture of the exhaled air, to pass into the gas phase much better, on the other hand.

The gas passes via a hot capillary having a higher temperature than the autosampler to the gas delivery system in turn having a higher temperature than the capillary. The quantity of gas passing through the capillary is no more than about 5 milliliters per minute. The gas delivery system of the mass spectrometer is so constituted as to compensate pressure and viscosity fluctuations, so that the same particle density is always injected into the analyzer of the mass spectrometer.

Mass spectrometers wherein an ion beam acts on the test molecules in high vacuum are used for analyzing the gaseous test mixtures. This type of mass spectrometer requires no calibration for obtaining quantitative concentration values for the individual detected masses. Absolute concentrations are thus directly stated. The inventive mass spectrometer further allows linear detection of the concentrations of the masses in the concentration range of $10^{-7}$ percent by volume (parts per billion) up to $10^{2}$ percent by volume, i.e. in a range of $10^{9}$. This means that the quantities of the determined masses are obtained directly from the measurement.

The components of the gaseous mixture are detected in accordance with their molecular mass in the mass spectrometer. For this purpose, the test gas is introduced into a high vacuum chamber and converted into ions, which are subsequently selected in accordance with their mass through electromagnetic fields and counted in a particle counter.

The action of an ion beam on the molecular beam of the sample of gaseous mixture in high vacuum preferably comprises a mercury ion beam. The mercury ion beam has an ionization energy of 10.4 electron volts, which is sufficient for ionizing over 90 percent of the compounds to be determined. In contrast, the main components of expiratory air such as $N_2$ and $O_2$ are not ionized, but selectively only the secondary components contained in expiratory air, which are thus exclusively detected. This permits quantitative determination even of components only present in traces up to $10^{-7}$ percent by volume. In addition, the mercury ion beam causes very few compounds to be fragmented.

Since different molecules may have identical molecular weights, such as $N_2$ and CO, or formaldehyde and NO, or $CO_2$ and $NO_2$, it is preferable for the mass spectrometer to use different ionization levels, that is, at least two primary ion beams, to permit differentiation between molecules with identical mass. This differentiation is based on the principle that each molecule has an individual ionization energy at which the molecule is transformed into an ion.

Further preferably, a mercury ion beam is used together with a krypton ion beam and/or a xenon ion beam. The different ion beams can be used during measurement in any order.

Accordingly, a krypton ion beam, which has an energy of 13.9 electron volts, can be used for example to distinguish the molecules $N_2$ and CO, which have identical mass, due to their different ionization potentials of 14.2 electron volts ($N_2$) and 13.7 electron volts (CO).

A further separation effect can be obtained by the formation of defined fragment ions. For example, the molecules, methanol and $O_2$, identical in mass are distinguished by ionization with a xenon ion beam (12.2 electron volts), which forms an $O_2^+$ ion with a mass of 32 and a $CH_3O^+$ ion with a mass of 31. Higher hydrocarbons require for example ionization energies in the range of 10 electron volts as are generated by a mercury ion beam with an energy of 10.4 electron volts.

Measurement of the samples of gaseous mixtures is done by determining quantitatively the concentrations of all masses up to a molecular weight after ionization of 500, preferably 200.

For respiratory air samples from human test subjects, 100 masses were detected on the mass spectrometer upon measurement of 200 possible masses. It has hitherto been possible to associate with these masses the compounds, carbon dioxide, carbon monoxide, water, ethanol, isoprene, methane, acetone, ammonia, formic acid, acetic acid, acetaldehyde, acetylene, acetonitrile, benzene, methylamine, formaldehyde, hydrogen sulfide, nitrous acid, methanol, oxygen, propanol, toluene, methyl group, ethyl group, nitrogen monoxide, protonated water as the water adduct, acetyl group, formyl group, formaldehyde* protonated water, pyridine, pentane, cyclopentane, methyl ethyl ketone, propionic acid, butyric acid, methyl mercaptan, ethylene, dinitrogen monoxide, propane and sulfur dioxide.

These substances can be qualitatively and quantitatively determined individually, in groups or altogether without there being interference between the individual determined components, i.e. without the quantitative determination of one component being disturbed by the presence of one of the other components.

The inventive method further offers the advantage that chemical compounds of all kinds, for example acids and bases, polar and nonpolar substances, can be measured simultaneously with one measurement.

Of great importance for the analysis of expiratory air samples is the validation of the samples, that is, the detection or discarding of samples that are contaminated or useless for other reasons. For this purpose, the $CO_2$ content of the sample is first ascertained. At a removal temperature of the test gas mixture from the vial of 65° C. there is normally a $CO_2$ content of about 2 to 3.5 percent by volume. It has been ascertained that this $CO_2$ value fluctuates only in the range of about 10 percent in normal expiratory samples. Therefore, if the measured $CO_2$ content is significantly outside this normal range it is to be assumed that either the test vial was improperly sealed or improperly handled, or the test subject used the wrong breathing technique so that expiratory air of the lung was not included. This and analogous criteria permit falsified samples to be discarded.

Analysis of the second reference vial with the ambient air surrounding the test subject (without the test subject's expiratory air) can be used to ascertain which substances contaminated the ambient air. Accordingly, such samples can also be discarded in case of excessive contamination with certain substances.

Validatability of the measurements by the aforementioned or further criteria is of utmost importance specifically for the field of medical diagnostics since they allow statements about the quality of the sample and thus considerably reduce the risk of faulty measurements and thus false statements about the test subject's state. Besides the determination of $CO_2$, one can also determine as a matter of routine $N_2$, $O_2$ and $H_2O$ as the main components of respiratory air.

The measuring process is repeated at least five times for each test vial and reference vial (5 cycles) and the mean values formed from these cycles. A cycle lasts about one minute for measuring 200 masses.

During the measuring process, first the test vial and then the reference vial are determined. The mean values are formed from the results of each measuring cycle.

If the determination of the reference vial shows that the test subject's ambient air was contaminated, either the sample can be discarded or the quantity of the component present as contamination in the expiratory air sample obtained from the difference (sample vial minus reference vial). This approach permits any contaminations in the vials to be eliminated since the difference of equal contaminations yields zero and results consisting of respiratory air and contaminations correspond to the actually exhaled value.

Some contamination components of ambient air can also be absorbed by the lung and therefore have a lower concentration in expiratory air than in ambient air. With such contaminations, it generally happens that they can no longer be absorbed when a certain concentration is exceeded in ambient air. One thus obtains a breakthrough curve when measuring expiratory air in dependence on the concentration of contamination.

In the measurement of expiratory air samples it has been ascertained that, on the one hand, the detected concentrations of water-insoluble or poorly water-soluble substances such as $CO_2$ drop continuously from the first cycle to the last cycle. This corresponds to the fact that the removal of the sample from the vial decreases the concentration of these substances in the vial. In contrast, it has been ascertained that the detected concentrations of water and water-soluble substances are roughly constant through all measuring cycles. One possible explanation could be the fact that water/water-soluble substances adsorbed on the glass walls of the glass vials restore the original concentration of these components after removal. There is thus a certain reservoir for these components in the glass vials. This ascertainment forms a further criterion for validation of respiratory air samples, since if samples have a different analysis behavior from that described, it can be concluded that the respiratory air sample was not obtained correctly or was falsified in another way. Such samples can therefore be recognized and optionally discarded.

Evaluation of the data is done by comparing the measured quantitative values for the components, which are determined either in terms of their mass or in terms of their chemical nature, with the normal values of the particular component. Thus, deviations of the content of components in the particular test subject's expiratory air from the normal state can be ascertained. Values outside the normal range of the particular component can then permit conclusions about the test subject's state of health.

The normal values can be obtained for example by serial measurements on a great number of test subjects for determining the normal state of human respiratory air. Normal values can also be taken from the literature as far as they are known. Normal values generally comprise a certain range.

Preferably, the quantitative values measured for the components are standardized to the value of one of the main components of the gaseous mixture, preferably $CO_2$. Standardization obtains a relation of the content of individual components to the actually exhaled quantity of respiratory air per test subject. This has the advantage that values between different test subjects, as well as values obtained by time-shifted measurements of one test subject's respiratory air, can be compared.

Further preferably, the value determined according to standardization is divided by the maximum value known for human test subjects. This results in values for the individual components between 0 and 1. This further simplifies evaluation and makes it clearer for the evaluating technical personnel (physicians).

Further preferably, correlations are established between the measured values of individual components to detect certain clinical pictures. For example, the ethanol/propanol ratio can be determined to permit statements about a possible hepatitis infection.

A particular advantage of the method in determining all components in a certain mass range is that an overall survey of a great variety of clinical pictures and metabolic processes is obtained. For example, it is known that in schizophrenia patients both pentane content and the content of $H_2S$ and $CS_2$ in expiratory air are elevated, so that if these components are simultaneously determined, other clinical pictures can be excluded in which only the content of one of these components is elevated.

The observable metabolic processes may be both anabolic processes and catabolic processes. The inventive method has in addition the advantage that it can also be performed by untrained personnel, which results in a saving of costs.

Evaluation of the measurements is advantageously done in EDP-aided fashion.

An embodiment of the inventive apparatus comprises a gas intake system with a flexible gas transfer capillary (3), which is preferably made of fused silica, has an inside diameter of 250 microns and is placed in a quarter inch Teflon tube. The Teflon tube furthermore contains a heating wire. The capillary (3) is connected with a cannula (2) for sampling from a test vial (1). The different components up to the perforated plate (5) have a higher temperature in the direction of gas flow. Preferably, the test vial (1) is heated to 65° C., the cannula (2) to 85° C. and the gas transfer capillary (3) to 100° C. This excludes condensation effects in the total system from the test vial to the mass spectrometer and guarantees efficient gas transfer. The small diameter of the capillary furthermore permits extremely small quantities of gas to be removed from the test vial. During the measuring process, which can range from a few seconds to 15 minutes depending on the number of compounds, a gradient vacuum thus arises that causes a selective concentration increase, and thus better detection limits, depending on the vapor pressure of the individual component. The gas intake system has the advantage that it is inert to the gaseous mixtures under analysis and thus has no memory effects. It is therefore unnecessary to rinse the system for analyzing a new sample.

Preferably, the gas flow through the capillary (3) is limited to no more than 5 milliliters per minute. In the area before the perforated plate a pressure of about 700 millibars prevails, if atmospheric pressure prevailed in the test vial before sampling. If an autosampler system is used, the cannula (2) is steered by a robot to the desired test vial.

Further, gas switching valves (4) are located in the area before the perforated plate (5) that permit zero gas and calibrating gas to be added, preferably up to a pressure of no more than 1.5 bars. However, the total gas stream must be greater than the back-diffusion.

In the area after the perforated plate (5), which preferably has a diameter of 300 microns and was produced by a laser beam, a pressure of about 20 millibars is produced by the pump (9), which is preferably a two-stage, oil-free vacuum pump with an inherent pressure 0.2 to 200 millibars.

Thus, when the cannula (2) is inserted into the test vial (1) in which atmospheric pressure approximately prevails, the gaseous mixture under analysis is guided in the direction of the negative pressure through the gas transfer capillary (3)

to the perforated plate (5), whereby a first molecular beam (6) is produced in the intermediate vacuum chamber (24) behind the perforated plate (5). In the area before the further capillary (10), which is likewise made of fused silica, this beam (6) has laminar flow.

In the intermediate vacuum chamber (24), the pressure of about 20 millibars is kept precisely at a constant value by a proportional control valve (8), which can let secondary air or inert gases flow into this space. The proportional control valve (8) is preferably controlled by a capacitive absolute pressure sensor (7) that measures the pressure within the intermediate vacuum chamber (24) precisely and independently of the composition of the gas. This guarantees that pressure fluctuations of the test molecular beam (6), as occur e.g. with repeated measurement from the same test vial, can be compensated and no changes in the viscosity of the test molecular flow occur in the capillary (10). Thus, a test molecular flow of constant particle density enters the further capillary (10).

In the intermediate vacuum chamber (24), in the area of the molecular beam (6), one end of the capillary (10) is located, said capillary having a preferred inside diameter of 250 microns and being heated to a temperature above 100° C., preferably 220° C. Heating of the capillary (10) causes the desorption times to be kept as small as possible.

Due to the value controlled to a constant pressure in the intermediate vacuum chamber (24), the gas jet pressure before the capillary (10) is always precisely the same. This assembly permits quantitative determination of components down to the range of $10^{-7}$ percent by volume.

The other end of the capillary (10) is located in the high vacuum chamber (22), in which a high vacuum, preferably of at least $10^{-7}$ millibars, is produced by for example a turbomolecular pump (23). The end of the capillary is located just before an open slot of the octupole guide field (16) in the charge exchange chamber (17). The pressure gradient existing in the capillary (10) causes the test molecular beam (6) to pass through the capillary (10) into the charge exchange area (17) of the high vacuum chamber (22), whereby it forms a second molecular beam (11) at the end of the capillary (10).

The primary ion beam (12) for ionizing the molecular beam (11) is so formed that gas is removed in reduced-pressure fashion from one of the gas reservoirs (13) of mercury, krypton and xenon and guided to the electron impact source (14) comprising hot tungsten filament, anode and shutter.

The resulting primary ion beam (12) is guided through a first octupole guide field (15). Only high molecular weights (primary ions) are guided, and the masses of impurities in the gas reservoirs (13) are suppressed to obtain a high signal-to-noise ratio for the substances to be measured.

The primary ion beam (12) is then guided further in a second octupole guide field (16) having the same transmission for all kinds of molecule. This octupole guide field (16) contains the charge exchange zone (17) in which the primary ion beam (12) hits the test molecular beam (11). In the charge exchange zone (17) a test molecule ion beam (18) is produced in single-impact processes at a mean pressure of 10 millibars, the test molecules then being separated in the quadrupole analyzer (19) in accordance with their mass-to-charge ratio. The test molecule ions are then converted into electronically processible electronic pulses in the ion detector (20). The electronic pulses are then coupled out for the counting electronics (21).

Octupole assemblies for mass spectrometers on the basis of ion beams are described for example in EP 0 290 712 and DE 196 28 093. The disclosure of these prints is incorporated herein by reference.

In the following the present invention will be illustrated further by an example.

EXAMPLE

To ascertain the state of health, analyses of the expiratory air of nine test subjects were done in a clinical test. Samples of the particular test subject's expiratory air were taken by the test subject inhaling and exhaling a few times evenly through the nose, holding his breath for two to three seconds and then exhaling the air evenly through a straw whose end was located one to two centimeters above the bottom of a glass vial with a volume of 20 cubic centimeters.

Then each test vial was sealed with a crimp cap using crimping pliers. This sealing was done at the latest about five seconds after the test subject exhaled into the vial.

Parallel to each test vial, a second vial (reference vial) was sealed in the test subject's surroundings without the atmosphere in the reference vial coming in contact with the test subject's expiratory air.

Test vial and reference vial were each placed in an autosampler and prethermostated to 65° C. for at least 10 minutes.

After prethermostating, first the test subjects' test vials and then their reference vials were determined by the above-described embodiment of the inventive apparatus. Measurement of each vial was done in at least six cycles, i.e. the content of each vial was determined at least six times. The mean value was then formed from the at least six values obtained for the particular mass.

To eliminate contaminations in the ambient air, the mean value obtained for the particular reference vial was then subtracted from the mean value obtained for the test vial for the particular mass. Then the mean values were standardized to the value of $CO_2$ by dividing the mean values by the value obtained for $CO_2$.

The standardized values were then divided by the maximum value for the particular mass known from a serial measurement on a great number of test subjects for this mass. Values between 0 and 1 were thus obtained for the individual masses.

Figure 2:
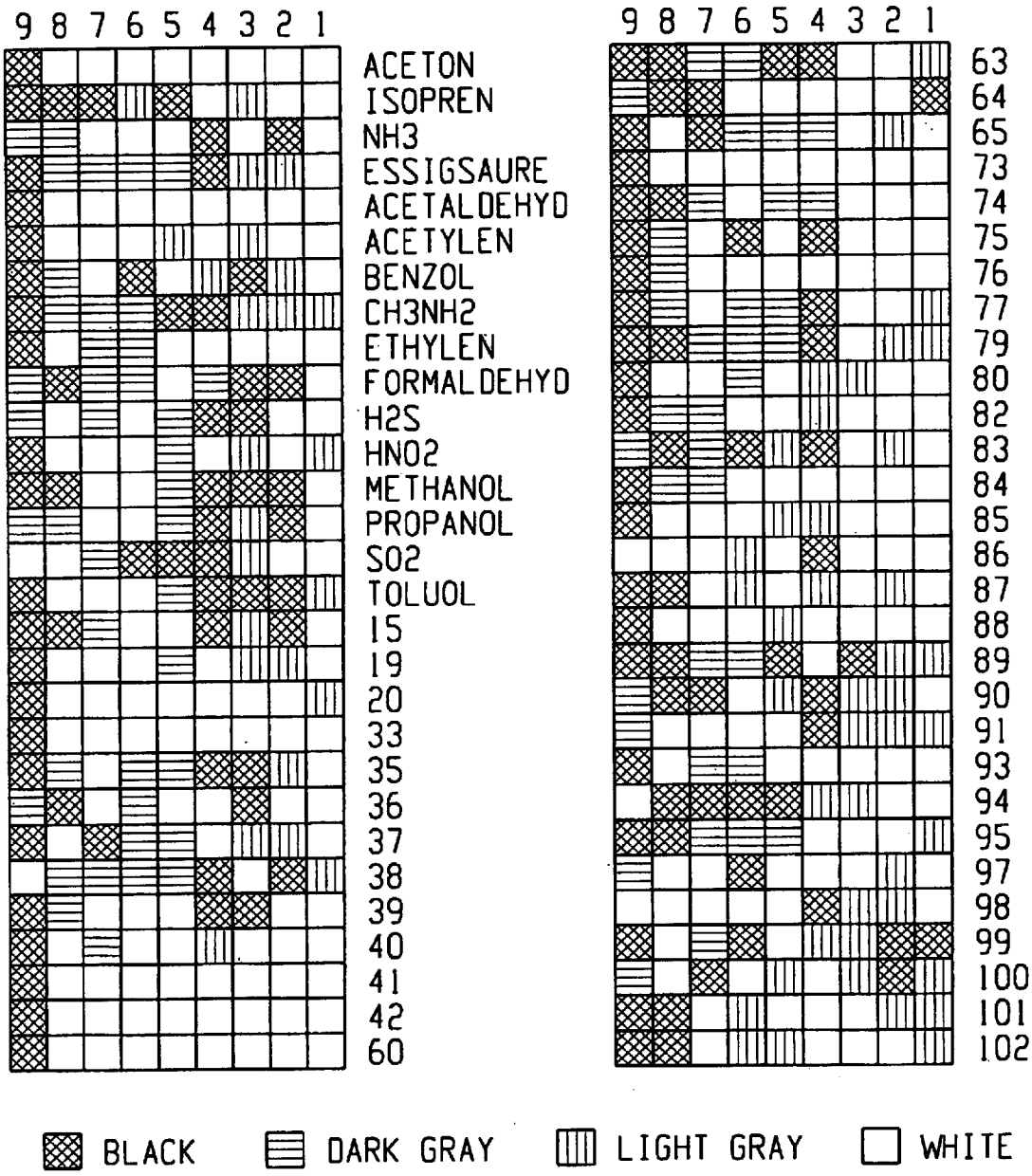
FIG. 2 shows a graph of the results of the measurements of the example.

FIG. 2 shows a graph of the results of the measurements on the nine test subjects. The values of the detected masses are shown in the range from 0 to 102 according to the following code:

| | |
|---|---|
| Black: | Range 0.75–1 |
| Dark gray: | Range 0.5–0.75 |
| Light gray: | Range 0.25–0.5 |
| White: | Range 0–0.25 |

Lines 1 to 9 show the values for test subjects 1 to 9. The columns show the particular values for the masses. Where masses could be assigned to chemical compounds, the compound is stated instead of the mass.

FIG. 2 indicates that the values for test subject 9 differ distinctly from the values for the other test subjects. At the time of sampling, test subject 9 showed an unclearly defined clinical picture, there being a suspicion of a septic process, i.e. a bacterial infection resulting in a liver and clotting disorder. A few days after sampling, test subject 9 suffered brain death and eventually final death.

This example shows that the state of a test subject with a serious health disturbance can be determined in comparison to that of other test subjects.

What is claimed is:

1. A method for assessing the state of organisms and natural products emitting substances into the surrounding atmosphere wherein one or more of said substances are determined in a gaseous mixture, determination being done by a mass spectrometer wherein an ion beam acts on the sample of gaseous mixture in high vacuum in such a way that the test molecules are ionized with the aid of the internal energy of the ions of the ion beam, and the values obtained upon determination are evaluated for assessing the state, wherein the gaseous mixture comprises main and secondary components and at least one main component is determined in the concentration range greater than or equal to 0.1 percent by volume and at least one secondary component in the concentration range less than or equal to 0.1 percent by volume.

2. A method according to claim 1, wherein at least one main component is determined in the concentration range greater than or equal to 1 percent by volume and at least one secondary component in the concentration range less than or equal to 0.03 percent by volume.

3. A method according to claim 2, wherein a correlation is established between at least one main component and at least one secondary component for evaluating the data obtained by the mass spectrometer.

4. A method according to claim 1, wherein a correlation is established between at least one main component and at least one secondary component for evaluating the data obtained by the mass spectrometer.

5. A method according to claim 1, wherein two or more substances of the gaseous mixture with different molecular structure are determined with one measurement.

6. A method for analyzing a gaseous mixture with one or more main components and one or more secondary components wherein at least one main component determined in the concentration range greater than or equal to 0.1 percent by volume and at least one secondary component in the concentration range less than or equal to 0.1 percent by volume by a mass spectrometer wherein an ion beam acts on the sample of gaseous mixture in high vacuum in such a way that the test molecules are ionized with the aid of the internal energy of the ions of the ion beam.

7. A method according to claim 6, wherein at least one main component is determined in the concentration range greater than or equal to 1 percent by volume and at least one secondary component in the concentration range less than or equal to 0.03 percent by volume.

8. A method according to claim 6 wherein a correlation is established between at least one main component and at least one secondary component for evaluating the data obtained by the mass spectrometer.

9. A method for assessing the state of organisms and natural products emitting substances into the surrounding atmosphere wherein one or more of said substances are determined in a gaseous mixture, determination being done by a mass spectrometer wherein an ion beam acts on the sample of gaseous mixture in high vacuum in such a way that the test molecules are ionized with the aid of the internal energy of the ions of the ion beam, and the values obtained upon determination are evaluated for assessing the state, wherein all components of the gaseous mixture having a vapor pressure greater than or equal to $10^{-3}$ milibars are determined.

10. An apparatus for analyzing a gaseous mixture comprising a mass spectrometer with a gas delivery system wherein a molecular beam is produced in an intermediate vacuum from the sample of gaseous mixture under analysis, a second molecular beam then being produced from said beam in high vacuum by means of a pressure gradient in a capillary and the test molecules of the second molecular beam ionized, the pressure of the intermediate vacuum being kept constant.

11. An apparatus according to claim 10, wherein the test molecules of the second molecular beam are ionized with the aid of the internal energy of the ions of an ion beam.

12. An apparatus according to claim 10, wherein the ionized molecular beam is stored with the aid of an octupole guide field.

13. An apparatus according to claim 10, wherein the pressure of the intermediate vacuum is 0.2 to 200 millibars.

14. An apparatus according to claim 13, wherein the pressure of the intermediate vacuum is 1 to 100 millibars.

15. An apparatus according to claim 13, wherein the pressure of the intermediate vacuum is 5 to 50 millibars.

16. A method for assessing the state of humans or animals and natural products emitting substances into the surrounding atmosphere wherein one or more of said substances are determined in a gaseous mixture, determination being done by a mass spectrometer wherein an ion beam acts on the sample of gaseous mixture in high vacuum in such a way that the test molecules are ionized with the aid of the internal energy of the ions of the ion beam, and the values obtained upon determination are evaluated for assessing the state, wherein the gaseous mixture comprises main and secondary components and at least one main component is determined in the concentration range greater than or equal to 0.1 percent by volume and at least one secondary component in the concentration range less than or equal to 0.1 percent by volume.

17. A method for assessing the state of humans or animals and natural products emitting substances into the surrounding atmosphere wherein one or more of said substances are determined in a air exhaled by the human or animal, determination being done by a mass spectrometer wherein an ion beam acts on the sample of gaseous mixture in high vacuum in such a way that the test molecules are ionized with the aid of the internal energy of the ions of the ion beam, and the values obtained upon determination are evaluated for assessing the state, wherein the gaseous mixture comprises main and secondary components and at least one main component is determined in the concentration range greater than or equal to 0.1 percent by volume and at least one secondary component in the concentration range less than or equal to 0.1 percent by volume.

* * * * *